US010820776B2

(12) United States Patent
Cantrell et al.

(10) Patent No.: US 10,820,776 B2
(45) Date of Patent: Nov. 3, 2020

(54) FLUID FLOW STRUCTURE AND METHOD OF USE FOR CONTINUOUS MOTION WASHING MACHINE

(71) Applicant: Unified Brands, Inc., Jackson, MS (US)

(72) Inventors: John W. Cantrell, San Antonio, TX (US); Mark Churchill, Grain Valley, MO (US); David Robert Gast, Lenexa, KS (US); John N. McCreight, Leawood, KS (US); Bryon J. London, Prairie Village, KS (US)

(73) Assignee: Unified Brands, Inc., Jackson, MS (US)

( * ) Notice: Subject to any disclaimer, the term of this patent is extended or adjusted under 35 U.S.C. 154(b) by 56 days.

(21) Appl. No.: 15/695,888

(22) Filed: Sep. 5, 2017

(65) Prior Publication Data

US 2018/0055331 A1 Mar. 1, 2018

Related U.S. Application Data

(63) Continuation of application No. 14/379,190, filed on Aug. 15, 2014, now Pat. No. 9,750,388, which is a
(Continued)

(51) Int. Cl.
*A47L 15/42* (2006.01)
*B08B 3/04* (2006.01)
(Continued)

(52) U.S. Cl.
CPC ..... *A47L 15/4221* (2013.01); *A47L 15/0092* (2013.01); *A47L 15/08* (2013.01);
(Continued)

(58) Field of Classification Search
None
See application file for complete search history.

(56) References Cited

U.S. PATENT DOCUMENTS 3,226,095 A 12/1965 Ranson
3,314,659 A 4/1967 Ranson
(Continued)

FOREIGN PATENT DOCUMENTS

AU 2010238773 B2 10/2010
AU 2016244318 A1 11/2016
(Continued)

OTHER PUBLICATIONS

Written Opinion of the International Search Report for PCT/US13/026705 (dated Jun. 3, 2013).
(Continued)

*Primary Examiner* — Cristi J Tate-Sims
(74) *Attorney, Agent, or Firm* — Kutak Rock LLP

(57) ABSTRACT

A washing machine and/or a fluid flow structure for a washing machine wash tank is provided. The wash tank is generally rectangular and includes a bottom wall, two side walls and two end walls extending upwardly from said bottom wall. The wash tank further includes at least one flow directional opening in at least one of the walls. In a preferred embodiment, the wash tank includes a plurality of flow directional openings positioned along one of the side walls of the wash tank. A fluid flow structure is located within said wash tank, which includes a fluid flow guide surface, and a support for said guide surface. The guide surface includes an expansion structure that is designed to counteract expansion of the guide surface that occurs during operation of the washing machine. In one embodiment the expansion structure is an expansion slot that engages a portion of the guide surface. As the guide surface expands the expansion slot is pressed against the portion of the guide surface, causing the
(Continued)

expansion slot to expand into a relief area associated with the expansion slot at a location generally opposite of the portion of the guide surface.

32 Claims, 5 Drawing Sheets

Related U.S. Application Data continuation of application No. PCT/US2013/026705, filed on Feb. 19, 2013, and a continuation-in-part of application No. 12/765,838, filed on Apr. 22, 2010, now Pat. No. 10,028,636.

(60) Provisional application No. 61/600,581, filed on Feb. 17, 2012, provisional application No. 61/171,752, filed on Apr. 22, 2009, provisional application No. 61/177,105, filed on May 11, 2009, provisional application No. 61/227,686, filed on Jul. 22, 2009, provisional application No. 61/231,987, filed on Aug. 6, 2009, provisional application No. 61/233,811, filed on Aug. 13, 2009, provisional application No. 61/236,801, filed on Aug. 25, 2009, provisional application No. 61/255,083, filed on Oct. 26, 2009, provisional application No. 61/266,430, filed on Dec. 3, 2009.

(51) Int. Cl.

| | |
|---|---|
| ***B08B 3/02*** | (2006.01) |
| ***A47L 15/00*** | (2006.01) |
| ***A47L 15/08*** | (2006.01) |
| ***B08B 3/00*** | (2006.01) |
| ***B08B 3/10*** | (2006.01) |
| ***F15D 1/00*** | (2006.01) |
| *A47L 15/16* | (2006.01) |

(52) U.S. Cl.

CPC ..... *B08B 3/006* (2013.01); *B08B 3/02* (2013.01); *B08B 3/04* (2013.01); *B08B 3/102* (2013.01); *F15D 1/0005* (2013.01); *A47L 15/16* (2013.01); *Y10T 137/8593* (2015.04)

(56) References Cited

U.S. PATENT DOCUMENTS

| | | | | |
|---|---|---|---|---|
| 4,712,351 | A | 12/1987 | Kasprzak | |
| 4,773,435 | A | 9/1988 | Ikeda et al. | |
| 4,773,436 | A | 9/1988 | Cantrell et al. | |
| 6,115,541 | A | 9/2000 | Rhodes | |
| 7,228,975 | B2 | 6/2007 | Yang | |
| 7,854,030 | B2 | 12/2010 | Lee et al. | |
| 9,027,575 | B2 | 5/2015 | Cantrell et al. | |
| 9,750,388 | B2 | 9/2017 | Cantrell et al. | |
| 10,028,636 | B2 | 7/2018 | Cantrell et al. | |
| 2003/0041886 | A1* | 3/2003 | Cantrell ..... | A47L 15/0092 134/182 |
| 2003/0041887 | A1 | 3/2003 | Cantrell et al. | |
| 2004/0107977 | A1 | 6/2004 | Cantrell et al. | |
| 2004/0244822 | A1 | 12/2004 | Cantrell et al. | |
| 2005/0028847 | A1 | 2/2005 | Kaczmarek | |
| 2006/0196528 | A1 | 9/2006 | Jarvis | |
| 2008/0011328 | A1 | 1/2008 | Cantrell et al. | |
| 2008/0093314 | A1 | 4/2008 | Classen | |
| 2008/0099055 | A1 | 5/2008 | Lemley | |
| 2010/0224220 | A1 | 9/2010 | Cantrell et al. | |
| 2011/0017241 | A1 | 1/2011 | Cantrell | |
| 2011/0174339 | A1 | 7/2011 | Cantrell et al. | |
| 2015/0013730 | A1 | 1/2015 | Cantrell et al. | |
| 2018/0325347 | A1 | 11/2018 | Cantrell et al. | |

FOREIGN PATENT DOCUMENTS

| | | | |
|---|---|---|---|
| AU | 2016244318 | B2 | 11/2016 |
| AU | 2018236823 | A1 | 10/2018 |
| CA | 2768761 | A1 | 10/2010 |
| CN | 1387414 | A | 12/2002 |
| CN | 101366619 | A | 2/2009 |
| CN | 102458209 | A | 5/2012 |
| CN | 102458209 | B | 9/2014 |
| CN | 104274139 | A | 1/2015 |
| DE | 202004017681 | | 9/2005 |
| EP | 0372342 | A1 | 6/1990 |
| EP | 2429370 | A1 | 3/2012 |
| GB | 1227798 | A | 4/1971 |
| WO | WO 2010-124149 | | 10/2010 |
| WO | 2013123506 | A1 | 8/2013 |

OTHER PUBLICATIONS

Written Opinion of the International Search Report for PCT/US10/032137 (dated Jun. 21, 2010).
First Examiner report received for Application No. 2018236823, dated Aug. 5, 2019, 2 pages.
Non Final Office Action received for U.S. Appl. No. 16/042,824, dated Aug. 22, 2019, 24 pages.
Examination Report No. 1 received for Australian Patent Application Serial No. 2010238773 dated Sep. 18, 2015, 3 pages.
Examination Report received for Canadian Application No. 2,768,761, dated Oct. 22, 2018, 3 pages.
Extended European Search Report received for European Application No. 10767806.2, dated Dec. 15, 2017, 9 pages.
Final Office Action received for U.S. Appl. No. 12/765,838 dated Nov. 3, 2017, 7 pages.
Final Office Action received for U.S. Appl. No. 12/765,838 dated Aug. 22, 2014, 12 pages.
First Examination Report received for Australian Application No. 2016244318, dated Jan. 15, 2018, 4 pages.
First Office Action received for Chinese Patent Application Serial No. 201410412324.6 dated Jul. 20, 2016, 24 pages (including English Translation).
International Preliminary Report on Patentability received for PCT Application Serial No. PCT/US2010/032137 dated Oct. 25, 2011, 9 pages.
International Preliminary Report on Patentability received for PCT Application Serial No. PCT/US2013/026705 dated Aug. 28, 2014, 10 pages.
Non-Final Office Action received for U.S. Appl. No. 12/765,838 dated Oct. 31, 2013, 12 pages.
Non-Final Office Action received for U.S. Appl. No. 14/379,190 dated Apr. 18, 2016, 13 pages.
Non-Final Office Action received for U.S. Appl. No. 14/379,190 dated Oct. 7, 2016, 16 pages.
Notice of Allowance received for Canadian Application No. 2,768,761 dated Mar. 14, 2018.
Notice of Allowance received for China Application No. 201080028126.X dated Jun. 5, 2014, 4 pages.
Notice of Allowance received for U.S. Appl. No. 12/765,838, dated Mar. 27, 2018, 8 pages.
Notice of Allowance received for U.S. Appl. No. 14/379,190, dated Apr. 28, 2017, 9 pages.
Office action received for Canadian Application No. 2,768,761 dated Jul. 4, 2017, 4 pages.
Office action received for Canadian Application Serial No. 2,768,761 dated Feb. 15, 2016, 3 pages.
Office Action received for China Application No. 201080028126.X, dated Aug. 7, 2013, 31 pages.
Final Office Action received for U.S. Appl. No. 16/042,824 dated Feb. 24, 2020, 15 Pages.

* cited by examiner

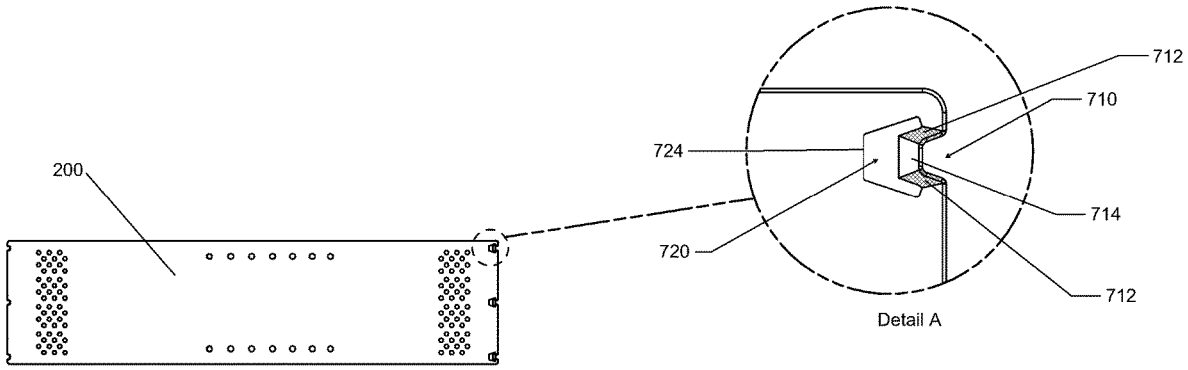
Fig. 7a
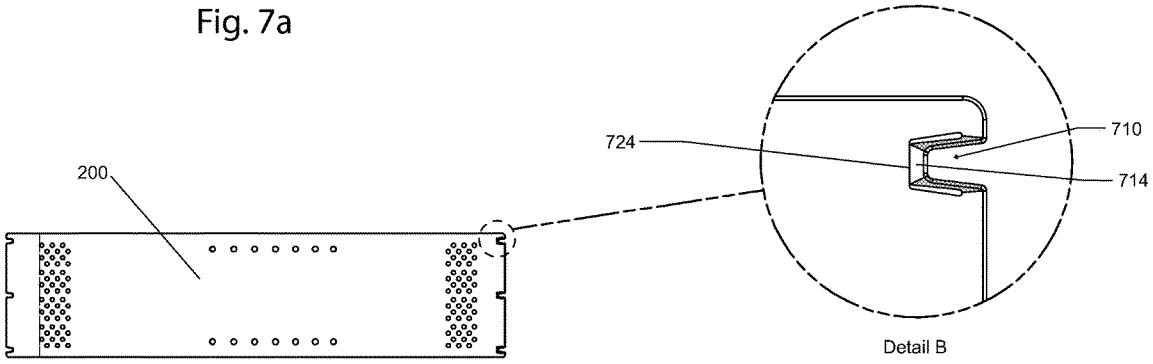
Fig. 7b
Fig. 7
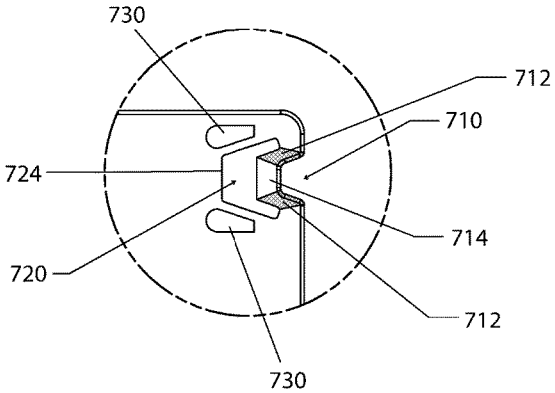
Fig. 8

FLUID FLOW STRUCTURE AND METHOD OF USE FOR CONTINUOUS MOTION WASHING MACHINE

CROSS-REFERENCE TO RELATED APPLICATIONS

This Application is a continuation of U.S. Non-provisional application Ser. No. 14/379,190 (now U.S. Pat. No. 9,750,388), which is a continuation-in-part of U.S. Non-provisional application Ser. No. 12/765,838, filed Apr. 22, 2010, which claims priority to U.S. Provisional Patent Application Ser. Nos. 61/171,752 filed Apr. 22, 2009, 61/177,105 filed May 11, 2009, 61/227,686 filed Jul. 22, 2009, 61/231,987 filed Aug. 6, 2009, 61/233,811 filed Aug. 13, 2009, 61/236,801 filed Aug. 25, 2009, 61/255,083 filed Oct. 26, 2009, and 61/266,430 filed Dec. 3, 2009, the entire disclosures of which are incorporated herein by reference. U.S. Non-provisional application Ser. No. 14/379,190 (now U.S. Pat. No. 9,750,388) also claims priority to then United States National Stage of Patent Cooperation Treaty Application No. PCT/US13/26705 filed Feb. 19, 2013, which claims priority to U.S. Provisional Patent Application Ser. No. 61/600,581, filed Feb. 17, 2012, the entire disclosure of which is incorporated herein by reference.

FIELD OF THE INVENTION

The present invention relates to a washing machine, a fluid flow structure (such as a removable wash tank insert) of a washing machine and methods of use of a fluid flow structure for a continuous motion washing machine (such as those used to wash items such as pots and pans and other ware, produce, etc.).

BACKGROUND OF THE INVENTION

Continuous motion washing machines, such as pot and pan washing machines of the type used in restaurants, institutions and other eating facilities, often involve a large wash tank or basin in which fluid is circulated to provide a rolling wash action for the pots, pans or other items being washed. One such machine is described in U.S. Pat. No. 4,773,436 issued to Cantrell et al., the entire disclosure of which is incorporated herein by reference. The machine of Cantrell includes a wash tank with multiple jets evenly spaced apart at an elevated position along the rear wall of the wash tank. The tank is filled with water (or other suitable wash fluid) to a level above the position of the jets. Pots and pans are placed in the wash tank, and a pump is activated to draw fluid from within the wash tank and direct it through the jets to create a jet stream. Each jet directs its jet stream toward the bottom wall of the wash tank, the bottom wall then deflects the jet stream upward and towards the front wall of the tank. The front wall then deflects the upward moving jet stream towards the rear wall of the tank, and the rear wall deflects the jet stream downward and back towards the front wall along the bottom wall. The combination of deflections of the jet stream from the bottom, front and rear walls provides a rolling washing action within the wash tank.

The basic components of the wash tank of the pot and pan washing machine of the prior art are shown in FIG. 1. Wash tank 10 includes end walls 12 and 14, rear side long wall 16, front side long wall 18 and bottom wall 19. A pump can be attached to either end wall; in the embodiment shown in FIG. 1, pump 50 is attached to right end wall 14. An impeller located within pump 50 is driven by electric motor 56. The impeller draws fluid into pump inlet 52 through an intake port (not shown) located in end wall 14. The fluid is then discharged from the pump through pump outlet 54 and into outlet manifold 60. Outlet manifold 60 includes a ninety degree turn, and several other turns, to direct the fluid across the back side of rear wall 16 and out jet nozzles 20 ("flow directional openings") which are protruding through and extending from rear wall 16. The intake port associated with pump inlet 52 is covered by perforated (holes, voids, mesh, etc.) intake manifold 30. Intake manifold 30 includes handle 36 and is removably supported within wash tank 10 for easy cleaning. Intake manifold 30 fits tightly between outer runner 32 and inner runner 34, each of which extends vertically from bottom wall 19. Heating element 40 is positioned between intake manifold 30 and end wall 14 for its protection and to maximize the use of space.

Although the prior art pot and pan washing machine disclosed in U.S. Pat. No. 4,773,436 provides an exceptional wash action, many of the components discussed above hinder the overall efficiency and performance of the machine. The inventions disclosed in U.S. Pat. Nos. 6,739,348, 7,162,788, 6,976,496, 7,246,624, 7,523,757, and 6,609,259, the entire disclosures of which are incorporated herein by reference, provide components that greatly increase the overall efficiency and performance of the machine, including improvements to the intake and discharge manifolds, jets, pump, drain, and system assembly methods. The inventions disclosed in U.S. patent application Ser. No. 12/781,750 (Application Pub. No. U.S. 2011-0120503 A1), the entire disclosure of which is incorporated herein by reference, provide improved rinsing and/or sanitizing systems and methods for washing machines. In addition, International Patent Application PCT/US09/59600 (Application Pub. No. WO 2010/040149) and U.S. patent application Ser. No. 13/080,453 (Application Pub. No. U.S. 2011-0240062 A1), the entire disclosures of which are incorporated herein by reference, provides a condition warning system, control system and control methods for a pot and pan washing machine that addresses a number of disadvantages in typical condition warning systems, control systems and control methods for such machines. U.S. patent application Ser. No. 13/021,682 (U.S. 2011-0240061 A1), the entire disclosure of which is incorporated herein by reference, provides control systems and control methods for a pot and pan washing machine that address yet other disadvantages in typical control systems and methods for such machine. Further in addition, U.S. patent application Ser. No. 12/765,838 (Application Pub. No. U.S. 2011-0017241 A1, the "AWI Application"), the entire disclosure of which is incorporated herein by reference, provides a wash tank insert that greatly improves the wash action within the wash tank and reduces impacts, noise and other vibrations acting on the walls of the wash tank. Notwithstanding these many improvements, the circulating wash action of these types of machines, causes a considerable amount of generally continuous force upon components of the machine due to multiple impacts of pots, pans and/or other items being circulated within the wash fluid. In particular, it has been discovered that this generally continuous force tends to cause material creep within (or expansion of) certain components, such as in certain embodiments of the wash tank insert of the AWI Application. This expansion results in the components eventually not fitting together properly, more difficulty, and/or no longer within the wash tank. Therefore, it would be beneficial to provide a wash tank insert system and methods that takes into account and/or reduces the detrimental effects as creep occurs.

SUMMARY OF THE INVENTION

The present invention comprises a fluid flow guide component of a wash tank insert for a pot and pan, or other similar washing machine. Several embodiments of the instant invention are discussed herein in connection with the washing machine and the wash tank insert (referenced herein as "AWI System") disclosed in U.S. application Ser. No. 12/765,838. Nevertheless, it will be appreciated that the system and methods of the instant invention may be utilized in connection with pot and pan washing machines (or components thereof), such as those described in any of U.S. Pat. Nos. 4,773,436, 6,739,348, 7,162,788, 6,976,496, 7,246,624, 7,523,757, and 6,609,259, U.S. application Ser. No. 12/781,750 (Application Pub. No. US 2011-0120503 A1), Ser. No. 13/021,682 (Application Pub. No. U.S. 2011-0240061 A1), Ser. No. 12/765,838 (Application Pub. No. U.S. 2011-0017241 A1), Ser. No. 12/842,984 (Application Pub. No. US 2011-0174339 A1), and International Patent Application No. PCT/US09/59600 (Application Pub. No. WO 2010/040149), as well as with any other washing machines, or various combinations of washing machine components now known or hereinafter developed without departing from the spirit and scope of the instant invention.

The washing machine of, or in association with, the instant invention includes a generally rectangular wash tank including a bottom wall, two side walls and two end walls extending upwardly from said bottom wall. In a preferred embodiment, the side walls are longer than the end walls. The wash tank further includes at least one flow directional opening in at least one of the walls. In a preferred embodiment, the wash tank includes a plurality of flow directional openings positioned along one of the side walls of the wash tank.

A fluid flow structure is located within said wash tank, which includes a fluid flow guide surface, and a support for said guide surface. The guide surface includes at least one region contoured inconsistently from the contour of at least one corresponding wall of the washing machine wash tank. In a preferred embodiment, the contour of the guide surface is generally curved. The contour of the guide surface aids in reducing and/or preventing the pinning of items that often occurs in rectangular wash tanks of the prior art. The support for the guide surface creates a gap between said guide surface and at least one wall of the washing machine wash tank. The fluid flow guide surface defines a washing area within the wash tank that is located generally opposite of the gap with respect to said fluid flow guide surface. The guide surface, support and/or associated gap at least partially isolates impacts, noise or other vibrations acting on the guide surface from acting on the walls of the washing machine wash tank.

In a preferred embodiment, the fluid flow guide surface is capable of alternatively being inserted into and removed entirely from the washing machine wash tank such that a circulating wash action will be created in the washing machine wash tank whether said guide surface is inserted into or removed from the washing machine wash tank. In this manner, the generally rectangular wash tank of the washing machine may be utilized with the fluid flow guide surface removed to wash large-sized items such as sheet pans. In one such embodiment, sheet pans, or other items are placed in a rack within the wash tank, such that the items being washed will have fluid circulating around them, but will not also roll within the wash action created within the wash tank. This provides a preferred cleaning action due to the difficulty in rolling larger items. When smaller items, such as pots, pans, produce, etc., are to be washed, the fluid flow guide surface is reinserted into the wash tank.

In other preferred embodiments, the support is also removable from the wash tank. In some embodiments the flow guide surface and/or the support are capable of removal without the use of any tools. This allows for quick and easy insertion of the guide surface and/or support depending upon varying washing needs.

In some embodiments of the instant invention, the fluid flow guide surface and/or the support is generally flexible. In a preferred embodiment, the fluid flow guide surface and/or the support is made of a generally flexible, non-metallic material such as UHMW (Ultra-high-molecular-weight polyethylene). The flexible fluid flow guide surface and/or the flexible support, provides for flexible motion of the guide surface (and/or support) that is independent of the walls of the wash tank. Thus, the guide surface can flex to absorb impacts or other vibrations before they are imparted upon the generally nonflexible (rigid) walls of the wash tank. This flexible motion, at least partially, isolates impacts, noise or other vibrations from acting on the walls of the wash tank.

When the fluid flow guide surface is made of a flexible material such as UHMW, it has been discovered that the fluid flow guide surface will expand as a result of the generally continuous force exerted upon the fluid flow guide surface exerted by the impacts of pots, pans and/or other items against the fluid flow guide surface during operation of the washing machine. As a result the fluid flow guide surface eventually will not fit together properly with other support components, is more difficult to fit together with support components, and/or will no longer fit within the wash tank. To account for this expansion, and its detrimental impact, the fluid flow guide surface of some embodiments of the instant invention includes a component that allows for a prescribed amount of expansion, allows for continuous automatic fit up adjustments throughout allowed use or an "allowed expansion" time frame, and provides a positive "change out" or "spent" indicator communicating to the user that the fluid flow guide surface should be replaced. In a preferred embodiment, the component includes an expansion slot in which a portion of the support component for the fluid flow guide surface engages. The expansion slot is associated with a relief area within the fluid flow guide surface. As the fluid flow guide surface expands, the expansion slot presses against the portion of the support component at which it is engaged. This force causes the expansion slot to expand into the relief area. When the expansion slot bottoms out on the relief area (i.e. the expansion slot no longer can expand into the relief area), the fluid flow guide surface should be replaced. Otherwise, the continued expansion of the fluid flow guide surface will increase the engagement pressure between the fluid flow guide surface and the support component, resulting in the same or similar difficulties in fitting the fluid flow guide surface within the support component. Before the expansion slot bottoms out, the pressure remains generally neutral due to the ability of the expansion slot to expand into the relief area and thus counteract the expansion of the fluid flow guides surface. When the expansion slot bottoms out in the relief area, the fact that the relief area is "closed" or no longer exists provides a positive "change out" or "spent" indicator to the user, communicating to the user that the fluid flow guide surface should be replaced.

In some embodiments, the support component(s) comprises a plurality of interconnected ribs that are placed within the wash tank. The ribs are supported by the bottom wall of the wash tank and may additionally be supported by one or more of the side walls of the tank. The ribs are not mechanically affixed to the walls of the wash tank, but are instead supported through gravity, friction or some other form of non-attachable connection and which does not require any tools for removal. In preferred embodiments, a plurality of separate sections of interconnected ribs are utilized together in a single wash tank. In a preferred embodiment, each separate section includes a separate fluid flow guide surface that corresponds in length to the length of the section. The plurality of sections may fill the entire wash tank, or just a portion thereof, leaving such portion with the generally rectangular shape of the wash tank. This allows the portion without any section of ribs to be used for washing larger items, such as sheet pans. In a preferred embodiment, the combined length of the sections of ribs within the wash tank is sized to leave one or more voids between adjacent sections. This allows for a divider member to be at least primarily held in place between the two adjacent sections. It will be appreciated that other indexing structures, such as channels or tabs along the walls of the wash tank, may be utilized to further support the divider members, particularly toward the top of the wash tank.

In some embodiments of the instant invention, the fluid flow guide surface includes openings for allowing at least a portion of fluid flow directed from a flow directional opening to pass through the fluid flow guide surface. In some such embodiments, the fluid flow passes from a washing area defined by the fluid flow guide surface into the gap created by the support. In other embodiments, the fluid flow passes through the fluid flow guide surface into the washing area defined by said fluid flow guide surface and opposite the gap.

In one preferred embodiment, at least a portion of said fluid flow guide surface is generally horizontally orientated within the wash tank to create the circulating wash action in the washing machine wash tank about a generally horizontal axis of the wash tank. Such an embodiment is particularly useful for washing machines in which a rolling wash action is intended to be created about the horizontal axis of the wash tank. In an other embodiment, the fluid flow guide surface is generally vertically orientated within the wash tank to create the circulating wash action in the washing machine wash tank about a generally vertical axis of the wash tank. Such an embodiment is particularly useful for washing machines in which the rolling wash action is intended to be created about the vertical axis of the wash tank.

In one embodiment at least a portion of the gap created by the support includes a void that associates with a pumping system intake of the washing machine. The void acts as a manifold to create a flow of fluid generally through the void and into the intake of the machine.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention and various features thereof.

BRIEF DESCRIPTION OF THE DRAWINGS

A preferred embodiment of the invention, illustrative of the best mode in which the applicant has contemplated applying the principles, is set forth in the following description and is shown in the drawings and is particularly and distinctly pointed out and set forth in the appended claims.

FIG. 4 is a top side perspective view of the fluid-flow plate insert structure. FIG. 4A is a top plan view of the fluid-flow plate insert structure of FIG. 4. FIG. 4B is a side elevation view of the fluid-flow plate insert structure of FIG. 4. FIG. 4C is a rear elevation view of the fluid-flow plate insert structure of FIG. 4. FIG. 4D is a frontal bottom perspective view of the fluid-flow plate insert structure of FIG. 4.

FIG. 7 includes two top plan views of a fluid flow guide surface of an embodiment of the instant invention. FIG. 7*a* and Detail A show a nominal sheet before an expansion slot has been expanded into a relief area of the fluid flow guide surface. FIGS. 7*b* and Detail B show an expanded sheet after the expansion slot has expanded into a relief area and bottomed out in the relief area.

FIG. 8 is a partial top plan view of an alternative embodiment of an expansion slot of the instant invention similar to that shown in FIG. 7.

DETAILED DESCRIPTION OF A PREFERRED EMBODIMENT

As required, a detailed embodiment of the present invention is disclosed herein; however, it is to be understood that the disclosed embodiment is merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 2:
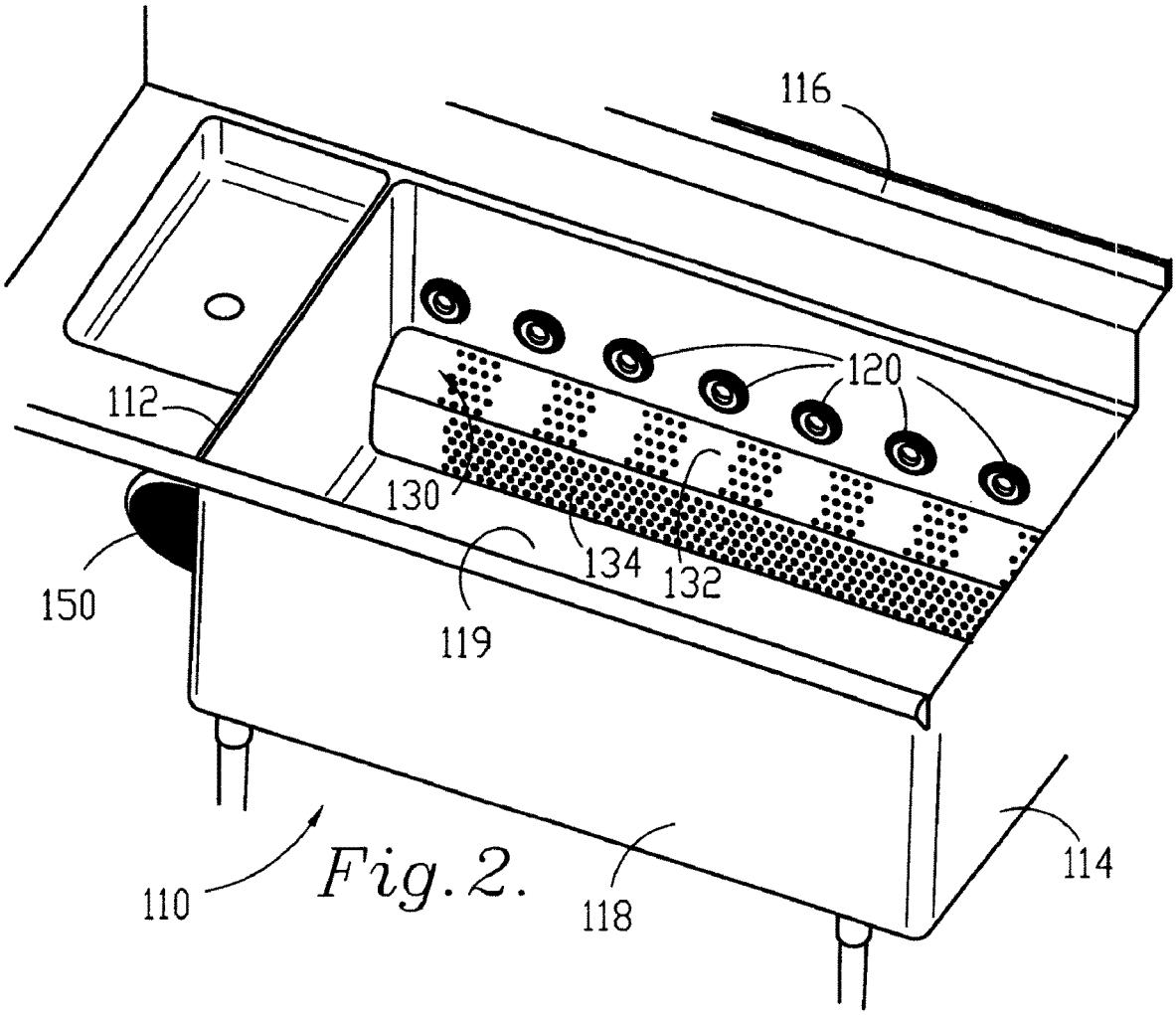
FIG. 2 is a fragmentary perspective view from above of another pot and pan washing machine including a generally linear intake manifold, in which embodiments of the instant invention may be incorporated.

Referring to FIG. 2, an embodiment of the wash tank of the instant invention is shown. The generally rectangular wash tank/basin of the instant invention is constructed in essentially the same manner as the wash tanks of the prior art. Wash tank 110 includes left end wall 112, right end wall 114, rear side long wall 116, front side long wall 118 and bottom wall 119 constructed in the same or similar manner, and of the same or similar materials as the wash tank of the prior art. Pump 150 is attached to left end wall 112 of the embodiment shown, Nevertheless, pump 150 can be attached to either left end wall 112 or right end wall 114 of wash tank 110. In addition it is understood that pump 150 could be attached to any other wall of the wash tank, or otherwise located separate from the wash tank and connected to the interior of the wash tank via a hose or other piping. Flush mounted jet nozzles 120 are mounted along rear wall 116 equally spaced apart from one another. Intake manifold 130 is mounted within wash tank 110 along the bottom portion of rear wall 116, below nozzles 120. Intake manifold 130 includes an upper portion 132 extending outwardly from rear wall 116 toward front wall 118, and lower portion 134 extending from the front end of upper portion 132. In a preferred embodiment, the upper portion of intake manifold 130 is angled downward from rear wall 116. The downward angle of the upper portion of intake manifold 130 corresponds to the downward angle of jet nozzle 120 which directs a fluid path toward the front portion of bottom wall 119, creating a circulating wash action in the wash tank about a generally horizontal axis of the wash tank. Portions of the intake manifold are perforated to allow fluid to be drawn into manifold 130 by the pump.

Figure 3:
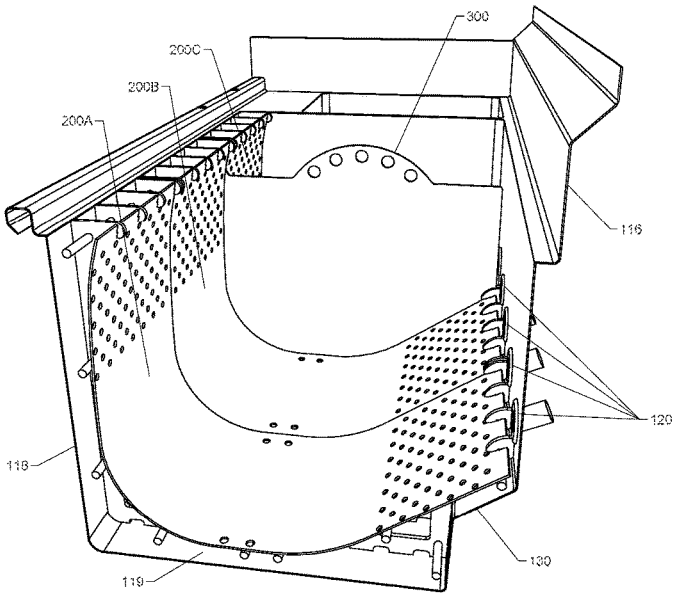
FIG. 3 is a side perspective partial sectional view of several fluid-flow plate insert structures of an embodiment of the instant invention positioned within the wash tank of a pot and pan washing machine of FIG. 2 and including a divider member between two adjacent sections of insert structures.

Referring to FIG. 3, an embodiment of the instant invention is shown utilizing an embodiment of the wash tank insert shown in U.S. application Ser. No. 12/765,838 that includes three sections (200*a*, 200*b* and 200*c*) of fluid-flow plate insert structures (illustrated generally in FIGS. 4, 4A, 4B, 4C and 4D) that are removably insertable within wash tank 110. Divider member 300 (shown generally in FIG. 5) is positioned in a void or slot between adjacent sections 200*b* and 200*c*. The fluid-flow plate insert structures shown in FIGS. 3 and 4 are generally horizontally orientated within wash tank 110 to aid in or create a circulating wash action about a generally horizontal axis of the wash tank.

Figure 4A:
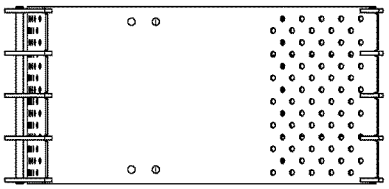
FIGS. 4, 4A, 4B, 4C and 4D are various views of an insert structure of the type shown in FIG. 3.
Figure 4B:
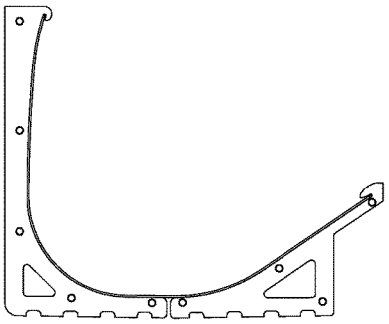
Figure 4C:
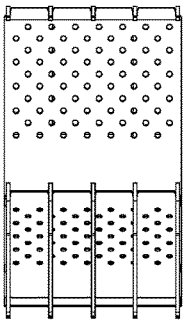
Figure 4:
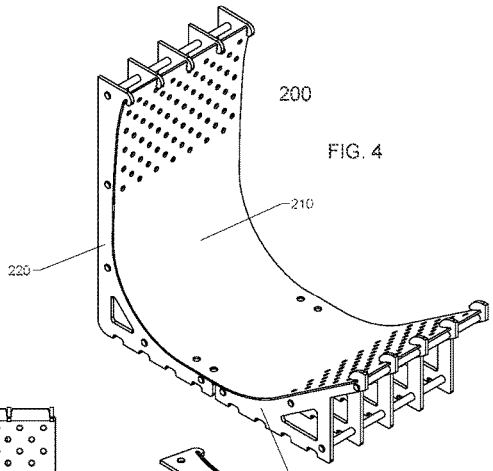
Figure 4D:
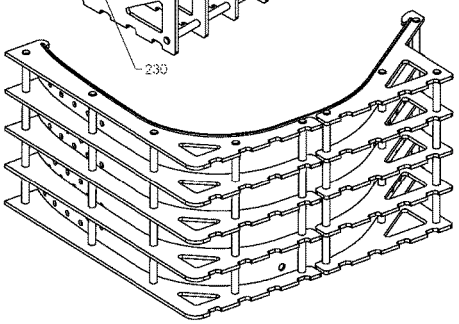
Figure 5:
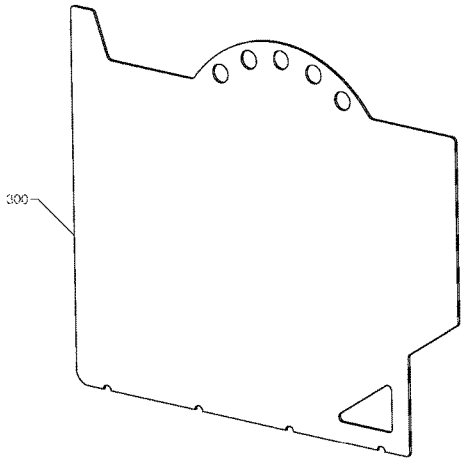
FIG. 5 is a side perspective view of the divider shown in FIG. 3.

FIG. 4 is a top side perspective view of a fluid-flow plate insert structure 200 generally of the type shown in FIG. 3. FIG. 4A is a top plan view of the fluid-flow plate insert structure of FIG. 4. FIG. 4B is a side elevation view of the fluid-flow plate insert structure of FIG. 4. FIG. 4C is a rear elevation view of the fluid-flow plate insert structure of FIG. 4. FIG. 4D is a frontal bottom perspective view of the fluid-flow plate insert structure of FIG. 4.

Figure 6:
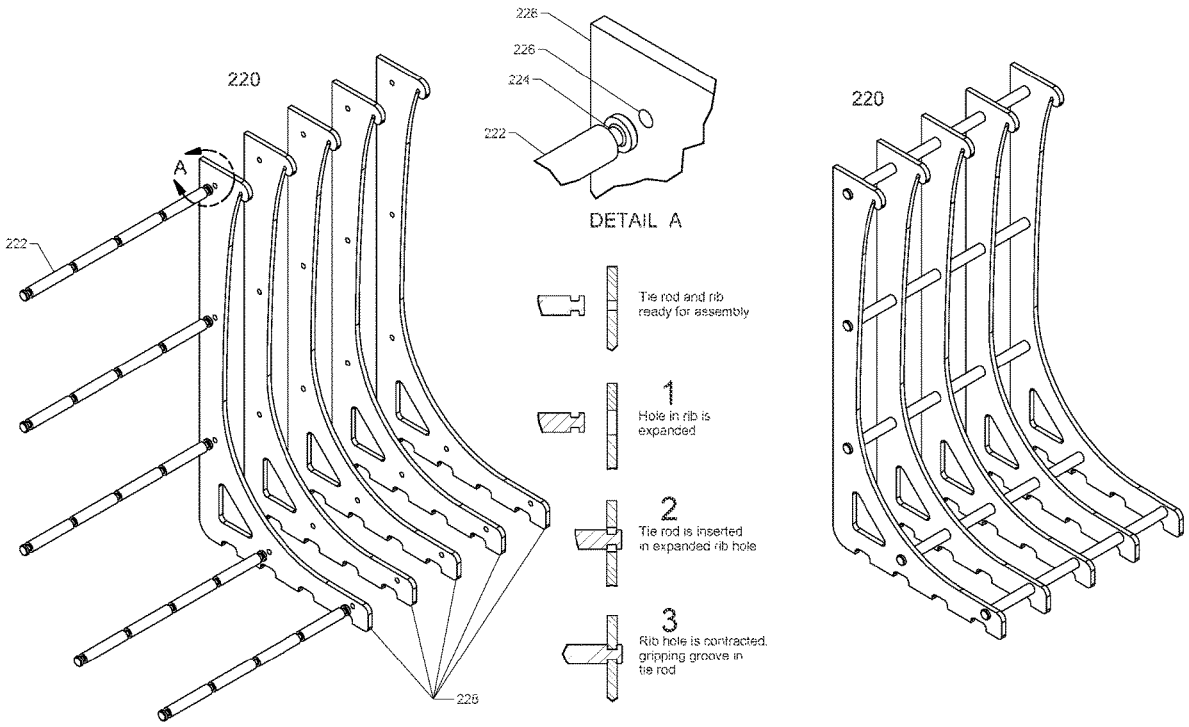
FIG. 6 include perspective views and detailed sectional views illustrating the assembly of an embodiment of a front support structure of the insert structure of FIG. 4.

As is discussed in more detail below, the fluid-flow plate insert structure(s) shown in FIGS. 3 (200*a*, 200*b* and 200*c*) and 4 (200) includes two separate support structures, front support 220 and rear support 230 that are each made up of a plurality of ribs 228, and a curved plate (fluid flow guide surface) 210 that rests on top of the support structures. In one embodiment the ribs are connected together by a plurality of ¼ inch diameter rods that run through holes bored in each rib. A cylindrical spacer is positioned on the rod between each rib and the ribs are held together by bolts on each end of the rod. In another embodiment, as is shown in FIG. 6, the ribs are connected together by a plurality of ½ inch diameter rods 222 that run through holes 226 bored in each rib 228. The rods 222 include annular grooves 224 at spaced intervals along the rods' surface. The diameter of the holes in the ribs through which the rod runs are slightly smaller than the diameter of the ½ inch rod. The material of the ribs is slightly flexible and/or malleable to allow the rib to be slid onto the rod until the rib snaps or engages into the grove and is held tightly in place. In such an embodiment, the spacers and bolts are not needed to connect the ribs together. It will be appreciated that alternative method of connecting ribs of a section may be utilized without departing from the spirit and scope of the instant invention. In some embodiments, the ribs include separate front and rear structures as are discussed above. In other embodiments, the front and rear structures are integral with one another. Other embodiments will be readily apparent to those of ordinary skill in the art.

As is discussed above, the fluid-flow plate 200 of FIG. 4 includes a plurality of ribs 228 (including front and rear structures 220 and 230). The ribs are spaced at regular intervals from one another and are fixedly attached to the next adjacent rib. As shown in FIG. 4A, the ribs are arranged such that the fluid-flow plate is generally rectangular in shape when viewed from the top. The fluid-flow plate sections of FIG. 3 (200*a*, 200*b* and 200*c*) are combined together to extend in length from one end wall to the opposite end wall of the wash tank (i.e. 112 to 114). The fluid-flow plate sections of FIG. 3 (200*a*, 200*b* and 200*c*), when viewed from the top, also are combined together to extend from the front to the back of the wash tank. Notwithstanding, it will be appreciated that fluid-flow plate structures that do not extend from end to end and/or from front to back of the wash tank are within the spirit and scope of the instant invention. For example, in one preferred embodiment, only sections 200*a* and 200*b* are included in wash tank 100 shown in FIG. 3, leaving the area in which 200*c* is located to merely include the generally rectangular shape of wash tank 110. This allows items such as a rack of sheet pans to be located in the area for cleaning without the use of insert section 200*c*, such that the maximum area of the rectangular wash tank may be utilized.

As shown in FIG. 4B, when viewed from the side, each rib includes a curve along the top of the rib such that the rib is much higher at the front (220) of the tank than at the back/rear (230) of the tank. Furthermore, the lowest point of the curve is generally at the middle of the tank, rather than at the front or back. Arranged with a plurality of ribs in parallel, each rib with substantially similar or identical curves, the fluid-flow guide surface 210 positioned on the ribs directs a portion of the fluid along the curve of the combined insert structure 200. The fluid is directed downward along the curve along the lower back portion of the wash tank. Once the fluid reaches the lowest point of the curve of the structure, the fluid is directed upward at the front portion of the wash tank. Some fluid also flows between the ribs in addition to along the curve of the tops of the structure. Thus, the fluid-flow plate provides a more efficient and quieter rolling action within the wash tank and helps to prevent pans and other objects from sticking to and/or striking the bottom of the wash tank.

The fluid-flow plate 200 shown in FIGS. 3 and 4 may be made of any material. In some embodiments, the ribs of the fluid-flow plate and/or guide surface are comprised of a stainless steel or other non-corrosive metal. Preferably, the ribs and guide surface include a material that partially is flexible and absorbs the impact of the pans and/or other objects being washed, such that blemishes ("dings") and noise are reduced. As discussed above, a vibration damping material, such as QUIET STEEL (available from Material Sciences Corporation), nylon, plastic, rubber coating, laminate, or other suitable material may be used. In some embodiments the curved plate and/or the ribs are flexible, in other embodiments the curved plate and/or ribs are rigid.

The fluid-flow plate insert 200 shown in FIG. 4 may be used with any size wash tank. As discussed above, multiple sections of inserts may be combined together to span the entire length of the wash tank, if desired. In addition, varying widths (from front to back) of the fluid flow guide surface 210 may be positioned within supports 220 and 230 to accommodate varying widths of wash tanks. In such manner, front support 220 and rear support 230 will be spaced further apart from one another for larger widths, and closer together to one another for smaller widths.

As is discussed above, the fluid-flow plate 200 includes a curved plate (fluid flow guide surface) 210 that rests on the tops of the two support structures. Each rib in each support structure includes a tab at the high end to receive an edge of the curved plate and maintain its position with respect to the support structure. When viewed from a side, such as shown in FIG. 4B, the curved plate is much higher at the front of the tank and curves downward toward the bottom of the tank at a location between the front and back of the tank. The curved plate curves upward again toward the rear of the tank, as shown in FIG. 4B. The curve is mostly vertical at the front of the tank and between vertical and horizontal at the back of the tank, as shown in FIG. 4B.

The curved plate includes a plurality of apertures toward the front and rear of the tank, as shown in e.g. FIG. 3. In some embodiments, the apertures are large enough, and spaced appropriately, such that a user can insert one or more finger to aid in the adjustment or removal of the curved plate within the tank. In other embodiments, the holes also help to accommodate surge in the wash level during operation of the machine. In still other embodiments, holes in the curved plate allow the fluid flow from the flow directional openings to be directed through the curved plate either into the wash area defined by the plate or into the gap created between the curved plate 210 and the walls of the wash tank by the support structure. In some embodiments, the rear apertures are sized and shaped to allow fluid to flow from the wash area through the apertures and into an intake manifold. In another embodiment, the pattern of apertures toward the rear portion of the curved plate are identical to that toward the front of the plate. In this manner, the insert of the instant invention may be easily assembled in either direction with no change in performance. In one such embodiment, the pattern includes both smaller apertures and larger apertures as are discussed above.

The fluid-flow plate 200 as shown in FIGS. 3 and 4 is a modular unit to accommodate different sized wash tanks. In the case of a wash tank with a longer length, front to back, the same support structures may be used by replacing the curved plate with a curved plate of longer length (front to back). In the case of a wash tank with a longer width, side end to side end, multiple support structures and curved plates are used side by side. In this manner, the fluid-flow plate as shown in FIGS. 3 and 4 can accommodate a large variety of wash tank sizes and configurations. The fluid-flow plate may be removed entirely from the wash tank and thus is compatible with other pot and pan washing systems.

In a preferred embodiment, the fluid-flow plate 200 shown in FIGS. 3 and 4 is inserted into the wash tank of a pot and pan washing machine by first placing the front support structure 220 in the bottom of the wash tank along the front wall of the wash tank and the back support structure 230 in the bottom of the wash tank along the rear wall of the wash tank. The curved plate 210, which originally is made of a generally flat material (such as a piece of sheet metal or plastic) is then inserted into the tabs at the high ends of the front and back support structures and curved to conform to the shape along the top surfaces of the support structures. The tension created by the curving of the plate causes the front and back support structures to be urged away from one another such that the front edge of the front support structure is pressed against the front wall of the wash tank and the rear edge of the rear support structure is pressed against the rear wall of the wash tank. This tension holds the fluid-flow plate in position within the wash tank. In alternative embodiments, the curved plate 210 is inserted into the support structures (220 and 230) prior to insertion of the fluid flow plate structure 200 into the wash tank.

In some embodiments the ribs of the front support structure are designed to be able to overlap the ribs of the back support structure when installed in a wash tank. This occurs when the combined width (i.e. front to rear of a wash tank and/or fluid-flow plate) of the front and back support structures is greater than the width of the wash tank. In such embodiments, the ribs of the front support structure must be slightly offset from the ribs of the back support structure to account for the overlap. In use, the larger the width of the tank, the wider the curved plate. The wider curved plate causes the opposing ends of the front and back support structures to be urged further apart from one another thereby accommodating a wider wash tank. In a preferred embodiment the front and back/rear support structures are identical to each other. The only difference is the width of the curved plate that is inserted. The larger the width of the tank, the wider the curved plate. The wider curved plate causes the opposing ends of the front and back support structures to be urged further apart from one another thereby accommodating a wider wash tank.

Figure 1:
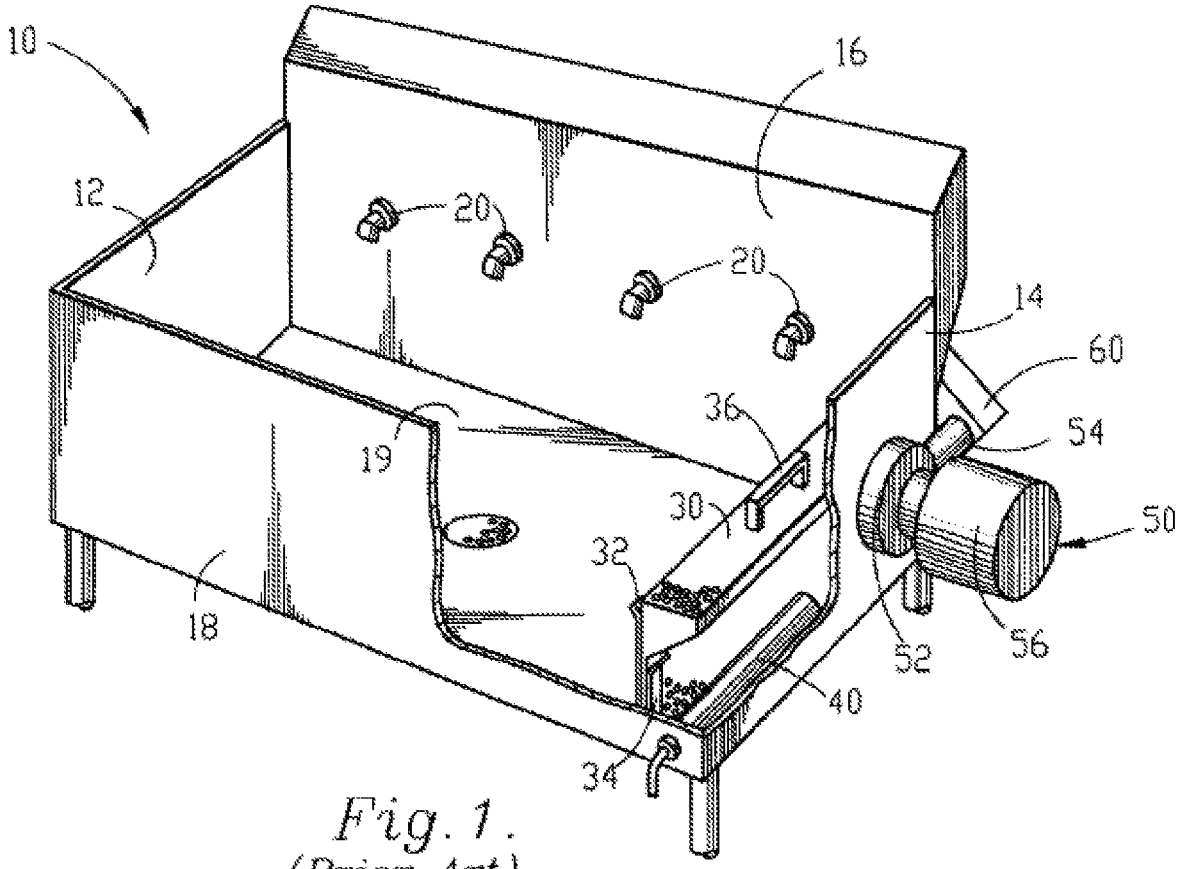
Fig. 1. (Prior Art)
FIG. 1 is a partial perspective view of a pot and pan washing machine of the prior art and in which embodiments of the instant invention may be incorporated.

As is shown in FIG. 4B, the ribs of both the front and back support structures each include scallops along the edges of the ribs that are placed in contact with the bottom wall of the wash tank. In alternative embodiments, scallops may be included in other surfaces (i.e. along the bottom edge of both ribs and/or along the front edge of the front rib and/or along the rear edge of the rear rib). In addition, both ribs include a number of holes or voids through the ribs. The scallops and holes/voids all act to cushion impacts from pots and pans and to reduce noise transmission. In a preferred embodiment, in which the fluid flow plate insert structure is utilized in connection with the wash tank 10 embodiment shown in FIG. 1, which includes an intake on the end wall of the wash tank, the holes/voids in the support structure allow fluid to flow freely through/around the ribs. In such embodiment, the holes/voids act as an intake manifold for the pumping system.

As is discussed above, the fluid flow plate structure 200 is a modular unit to accommodate different sized wash tanks. In the case of a wash tank with a longer width, front to back, the same support structures may be used by replacing the curved plate with a curved plate of longer length (front to back) as is discussed above. In the case of a wash tank with a longer length, side end to side end, multiple support structures and curved plates are used side by side. In this manner, the fluid-flow plate structure 200 can accommodate a large variety of wash tank sizes and configurations. The fluid-flow plate may be removed entirely from the wash tank and thus is compatible with other pot and pan washing systems.

In the embodiment shown in FIG. 3, three separate fluid-flow plate insert structures (200*a*, 200*b* and 200*c*) are utilized in a single wash tank. The three insert structures are placed side by side in the bottom of the wash tank in the manner described above. The combined length of the curved plates of the three insert structures is slightly less than the length (side end to side end) of the wash tank of the washing machine. This creates a slot or gap between the ends of adjoining insert structures and/or between an end of the insert structure(s) and the end wall of the wash tank. The dimension of the slot/gap/void is sized to accommodate a divider member, such as a metal or plastic member similar to that described in U.S. Pat. No. 7,523,757 the entire disclosure of which is incorporated herein by reference. The location of the slot/gap may be changed by the operator of the machine by changing the location of the three insert structures within the wash tank. In some embodiments, two of the insert structures are of equal length side to side as each other and are substantially longer than the third insert structure. This allows for a variety of different arrangements of the insert structures and the divider member within the wash tank to create a variety of isolated portions or areas within the wash tank. When not in use, the divider and gap can be positioned to be abutted against one of the end walls of the wash tank in the slot between the left end wall and the three insert structures. This results in a generally open wash tank arrangement (i.e. no isolated portions of the wash tank) and provides a convenient storage location for the divider member. It will be appreciated that the locations of the three inserts may be manipulated in a variety of different ways in addition to those shown and discussed here (for example, the shorter insert structure may be located in the middle of the two longer insert structures). In addition, it will be appreciated that the number of insert structures may either be increased or decreased to provide a variety of different arrangements within the wash tank. Further, it will be appreciated that the combined length of the curved plates of the insert structures may be manipulated to allow for multiple divider members within a single wash tank.

Referring to FIG. 7, an embodiment of the fluid flow guide surface 200 of the instant invention is shown in detail. FIG. 7*a* shows a "nominal sheet" of the fluid flow guides surface 200 when it is first manufactured, with an expansion slot 710 of the instant invention and relief area (window, cutout, or other area in which material is removed) 720 shown in Detail A. As is shown in Detail A, the expansion slot includes side walls 712 and bottom wall 714, which are designed to engage with a retention finger at the end of either support structure 220 or 230 to hold the fluid flow guide surface 200 within the support structures 220 and 230 within the wash tank. As the fluid flow guide surface 200 expands (as is shown in FIG. 7*b*), the force of the expansion against the retention fingers causes side walls 712 (shown in Details A and B with hatch marks) to stretch or expand into the relief area 714. As is shown in Detail B, the side walls 712 of expansion slot 710 will continue to stretch until the bottom wall 714 of the expansion slot bottoms out (i.e. contacts/engages) the bottom wall 724 of the relief area. As is seen in Detail B, when the expansion slot 710 is bottomed out in the relief area, the relief area 720 is no longer visible as the expansion slot is now located within the relief area. The closing or elimination of the relief area functions as a positive indicator to a user that the fluid flow guide surface 200 should be replaced.

FIG. 8 shows a partial plan view of another embodiment of the instant invention similar to that of FIG. 7. In FIG. 8, the expansion slot 710 is similar to that of FIG. 7, but additional secondary relief areas 730 are provided generally adjacent to the primary relief area 720. In the embodiment shown in FIG. 8, as the fluid flow guide surface 200 expands, the expansion slot 710 first expands into and bottoms out in relief area 720 in the manner discussed above. After expansion slot 710 bottoms out in relief area 720, the expansion slot continues to expand into relief areas 730. In this manner the primary relief area controls the material in the z-axis through the expansion process. It will be appreciated that the primary relief area 720 may be considerably smaller than that shown in FIG. 7, such that expansion slot 710 will bottom out in relief area 720 with only minimal expansion to maximize the z-axis control provides. In some embodiments, the amount of expansion allowed by the combination of the primary relief area 720 with the secondary relief areas 730 is equal to that provided in the embodiment shown in FIG. 7. It will be appreciated that other machine profiles that control the material in the z axis during the expansion process may be utilized without departing from the spirit and scope of the instant invention.

In one embodiment, the fluid-flow plate(s), discussed above is (are) made from stainless steel. In another embodiment, the fluid-flow plate and/or other components of the wash tank are made from a vibration damping material, such as QUIET STEEL (available from Material Sciences Corporation), plastic, or other suitable material. In still another embodiment, the fluid-flow guide surface of the wash tank insert is made of UHMW. As objects are washed and turned in the rolling motion of the wash tank, they frequently collide with the front and bottom. Such collisions can cause elevated decibel levels. A wash tank made of ordinary stainless steel combined with a fluid-flow plate made from a vibration damping material will keep noise levels within more tolerable limits as the pots and pans or other items will strike the fluid-flow plate rather than the bottom of the wash tank. Moreover, the pivotal connection or oscillating/flexible motion of the fluid-flow plate itself dampens the impact between pots and pans and the fluid-flow plate.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Although the foregoing detailed description of the present invention has been described by reference to an exemplary embodiment, and the best mode contemplated for carrying out the present invention has been shown and described, it will be understood that certain changes, modification or variations may be made in embodying the above invention, and in the construction thereof, other than those specifically set forth herein, may be achieved by those skilled in the art without departing from the spirit and scope of the invention, and that such changes, modification or variations are to be considered as being within the overall scope of the present invention. Therefore, it is contemplated to cover the present invention and any and all changes, modifications, variations, or equivalents that fall with in the true spirit and scope of the underlying principles disclosed and claimed herein (or in subsequent applications claiming priority to this application). Consequently, the scope of the present invention is intended to be limited only by any attached or subsequently provided claims, all matter contained in the above description and shown in the accompanying drawings shall be interpreted as illustrative and not in a limiting sense.

What is claimed is:

1. A fluid flow structure for a washing machine wash tank the fluid flow structure comprising:

a removable fluid flow guide surface, said guide surface being capable of alternatively being inserted into and removed entirely from the washing machine wash tank, said guide surface including at least one region contoured inconsistently from the contour of at least one corresponding wall of the washing machine wash tank; and a support for said guide surface, wherein said support creates a gap between said guide surface and an interior surface of at least one wall of the washing machine wash tank;

wherein said guide surface includes an expansion structure engaged with a portion of said support to counteract expansion of said guide surface; and wherein said expansion structure includes an expansion slot that engages a finger of said support.

2. The fluid flow structure as claimed in claim 1 wherein said expansion slot that is associated with a relief area within said fluid flow guide surface.

3. The fluid flow structure as claimed in claim 2 wherein said expansion slot expands into said relief area as said fluid flow guide surface expands and causes said expansion slot to press against said portion of said support.

4. The fluid flow structure as claimed in claim 3 wherein said relief area includes a bottom surface that defines a maximum expansion of said expansion slot and functions as a change out indicator for said fluid flow guide surface.

5. The fluid flow structure as claimed in claim 2 wherein said relief area comprises a primary relief area and a secondary relief area.

6. The fluid flow structure as claimed in claim 1 wherein a circulating wash action is created in the washing machine wash tank whether said guide surface is inserted into or removed from the washing machine wash tank.

7. The fluid flow structure as claimed in claim 1 wherein said guide surface and/or said support are capable of flexible motion independent of the walls of the washing machine wash tank.

8. The fluid flow structure as claimed in claim 7 wherein said flexible motion at least partially isolates impacts, noise or other vibrations acting on said guide surface from acting on the walls of the washing machine wash tank.

9. The fluid flow structure as claimed in claim 8 wherein said impacts, noise or other vibrations acting on said guide surface causes said guide surface to expand.

10. The fluid flow structure as claimed in claim 1 wherein said guide surface is capable of alternatively being inserted into and removed entirely from the washing machine wash tank without the use of any tools.

11. The fluid flow structure as claimed in claim 1 wherein said support is removably positioned within the washing machine wash tank.

12. The fluid flow structure as claimed in claim 1 wherein said at least one region contoured inconsistently from the contour of at least one corresponding wall of the washing machine wash tank is generally curved.

13. The fluid flow structure as claimed in 1 wherein said fluid flow guide surface is generally flexible.

14. The fluid flow structure as claimed in claim 1 wherein said support comprises a plurality of interconnected ribs.

15. The fluid flow structure as claimed in claim 1 wherein said fluid flow guide surface defines a washing area within said wash tank, said washing area being generally opposite said gap with respect to said fluid flow guide surface.

16. The fluid flow structure as claimed in claim 1 wherein said fluid flow guide surface and said support comprise a plurality of fluid flow guide surfaces and/or supports within the wash tank.

17. The fluid flow structure as claimed in claim 16 further comprising a divider member at least primarily held in place between two adjacent sets of said plurality of fluid flow guide surfaces and/or supports.

18. A fluid flow structure for a washing machine tank the fluid flow structure comprising:

a removable fluid flow guide surface, said guide surface being capable of alternatively being inserted into and removed entirely from the washing machine tank, said guide surface including at least one region contoured inconsistently from the contour of at least one corresponding wall of the washing machine wash tank; and a support for said guide surface, wherein said support creates a gap between said guide surface and an interior surface of at least one wall of the washing machine wash tank;

wherein said guide surface includes an expansion structure engaged with a portion of said support to counteract expansion of said guide surface, wherein said expansion structure includes an expansion slot that is associated with a relief area within said fluid flow guide surface, and wherein said expansion slot expands into said relief area as said fluid flow guide surface expands and causes said expansion slot to press against said portion of said support.

19. The fluid flow structure as claimed in claim 18 wherein said relief area includes a bottom surface that defines a maximum expansion of said expansion slot and functions as a change out indicator for said fluid flow guide surface.

20. The fluid flow structure as claimed in claim 18 wherein said relief area comprises a primary relief area and a secondary relief area.

21. The fluid flow structure as claimed in claim 18 wherein a circulating wash action is created in the washing machine wash tank whether said guide surface is inserted into or removed from the washing machine wash tank.

22. The fluid flow structure as claimed in claim 18 wherein said guide surface and/or said support are capable of flexible motion independent of the walls of the washing machine wash tank.

23. The fluid flow structure as claimed in claim 22 wherein said flexible motion at least partially isolates impacts, noise or other vibrations acting on said guide surface from acting on the walls of the washing machine wash tank.

24. The fluid flow structure as claimed in claim 23 wherein said impacts, noise or other vibrations acting on said guide surface causes said guide surface to expand.

25. The fluid flow structure as claimed in claim 18 wherein said guide surface is capable of alternatively being inserted into and removed entirely from the washing machine wash tank without the use of any tools.

26. The fluid flow structure as claimed in claim 18 wherein said support is removably positioned within the washing machine wash tank.

27. The fluid flow structure as claimed in claim 18 wherein said at least one region contoured inconsistently from the contour of at least one corresponding wall of the washing machine wash tank is generally curved.

28. The fluid flow structure as claimed in 18 wherein said fluid flow guide surface is generally flexible.

29. The fluid flow structure as claimed in claim 18 wherein said support comprises a plurality of interconnected ribs.

30. The fluid flow structure as claimed in claim 18 wherein said fluid flow guide surface defines a washing area within said wash tank, said washing area being generally opposite said gap with respect to said fluid flow guide surface.

31. The fluid flow structure as claimed in claim 18 wherein said fluid flow guide surface and said support comprise a plurality of fluid flow guide surfaces and/or supports within the wash tank.

32. The fluid flow structure as claimed in claim 31 further comprising a divider member at least primarily held in place between two adjacent sets of said plurality of fluid flow guide surfaces and/or supports.

* * * * *